US009504861B2

(12) United States Patent
Jones et al.

(10) Patent No.: US 9,504,861 B2
(45) Date of Patent: Nov. 29, 2016

(54) SAFETY LINE TRAVELLER

(75) Inventors: Karl Jones, Devizes (GB); Amir Tabatabai, Swindon (GB)

(73) Assignee: Latchways PLC, Devizes (GB)

( * ) Notice: Subject to any disclaimer, the term of this patent is extended or adjusted under 35 U.S.C. 154(b) by 269 days.

(21) Appl. No.: 12/989,976

(22) PCT Filed: Apr. 27, 2009

(86) PCT No.: PCT/GB2009/001078
§ 371 (c)(1),
(2), (4) Date: May 3, 2011

(87) PCT Pub. No.: WO2009/133360
PCT Pub. Date: Nov. 5, 2009

(65) Prior Publication Data

US 2011/0297480 A1 Dec. 8, 2011

(30) Foreign Application Priority Data

Apr. 28, 2008 (GB) ..... 0807707.5

(51) Int. Cl.
*A62B 35/00* (2006.01)

(52) U.S. Cl.
CPC ..... *A62B 35/0081* (2013.01); *A62B 35/0056* (2013.01)

(58) Field of Classification Search
CPC ..... A62B 35/0037; A62B 35/0043; A62B 35/0056; A62B 35/0062; A62B 35/0068; A62B 35/0081; A62B 35/0087
USPC ..... 182/36, 112, 115, 191
See application file for complete search history.

(56) References Cited

U.S. PATENT DOCUMENTS

| | | | | |
|---|---|---|---|---|
| 857,924 | A * | 6/1907 | Crandall | 104/115 |
| 2,333,646 | A * | 11/1943 | Frankel | 188/65.2 |
| 4,790,410 | A * | 12/1988 | Sharp et al. | 182/36 |
| 5,325,788 | A * | 7/1994 | Strickland et al. | 104/119 |
| 6,009,973 | A * | 1/2000 | Woodyard | 182/36 |
| 6,125,766 | A * | 10/2000 | Flux | 104/182 |
| 6,488,118 | B1 | 12/2002 | Corriveau | |
| 6,530,454 | B1 * | 3/2003 | Renton et al. | 182/36 |
| 6,945,357 | B1 * | 9/2005 | Flux | 182/36 |
| 7,007,772 | B2 * | 3/2006 | Argoud | 182/36 |
| 7,347,300 | B2 * | 3/2008 | Renton et al. | 182/36 |
| 7,992,680 | B2 * | 8/2011 | Small | 182/36 |
| 8,001,904 | B2 * | 8/2011 | Maes et al. | 104/112 |
| 2006/0124391 | A1 * | 6/2006 | Jones et al. | 182/36 |
| 2007/0119653 | A1 * | 5/2007 | Brown et al. | 182/36 |
| 2011/0073408 | A1 * | 3/2011 | Vetesnik | 182/3 |

FOREIGN PATENT DOCUMENTS

| | | |
|---|---|---|
| GB | 2291846 A | 2/1996 |
| GB | 2420820 A | 6/2006 |

* cited by examiner

*Primary Examiner* — Colleen M Chavchavadze
(74) *Attorney, Agent, or Firm* — Gordon & Jacobson, P.C.

(57) ABSTRACT

A safety line traveller (1) including a traveller body (3) having an open sided receiving channel (11) for receiving a longitudinal section of the safety line (2). An occluder element (5) is moveable between an open position in which access into and out of the channel (11) via the open side is at a maximum, and a closed position in which access into and out of the channel via the open side is at a minimum. The open side of the channel (11) being at least partly occluded by the occluder element (5) in the closed position.

14 Claims, 2 Drawing Sheets

SAFETY LINE TRAVELLER

BACKGROUND OF THE INVENTION

1. Field of the Invention

This invention relates to a traveller arranged to travel along a safety line attached to a building or other structure.

2. State of the Art

Personnel are typically attached a safety line traveller by means of a safety lanyard or other connection line. The traveller permits movement of personnel along the direction of the safety line while providing a fall arrest mechanism. The arrangement of the present invention permits the traveller to be attached to, and removed from, the safety line at any point along the safety line whilst preventing the release of the safety line from the traveller while a user is connected.

Many industries require personnel to work at height, thus running the risk of injury or death from falling. Therefore, it is desirable, and often a legal requirement, to provide fall arrest safety equipment for the protection of personnel who work in elevated locations. Typically, the user is connected to a traveller which is configured move along a safety line, the safety line being anchored to a secure structure. The safety line typically takes the form of a rail, cable or track running across, around or along the area in which the user is to work.

A connection line connects the user to the traveller. This connection line (or 'lanyard') is typically a flexible line, such as a strap, rope or the like. which allows the user a degree of movement on either side of the safety line. One end of the lanyard is connected to the traveller while the opposing end is connected to a harness worn by the user.

As the user follows the path of the safety line, the traveller trails behind and is pulled along the safety line by the lanyard. However, in the event of a fall the traveller remains secured to the anchored safety line thus arresting the fall and preventing injury.

A number of traveller devices are known in the prior art. However, known traveller devices are typically connected to the safety line by threading one end of the safety line through a space or channel formed in the body of the traveller. Thus, it is not possible to attach the traveller to the safety line at any chosen point along the length of the safety line. This is inconvenient and time consuming, as the user must locate and move to the end of the safety line before proceeding with his work.

Furthermore, it is imperative that the traveller is connected securely to the safety line such that, in the event of a fall, the traveller remains fixed to the anchored safety line. If the traveller has not been properly connected to the safety line, or if it is able to become disconnected in some way, the fall may not be arrested.

SUMMARY OF THE INVENTION

Thus, the object of the invention is to provide a safety line traveller which can be attached to a safety line at any point along the length of the safety line while reducing or eliminating the risk of user error when performing the attachment, and reducing or eliminating the risk of the safety line being dislodged or otherwise separated from the traveller.

Thus, in accordance with the present invention, there is provided a safety line traveller comprising a traveller body having an open sided receiving channel for receiving a longitudinal section the of safety line and an occluder element moveable between an open position in which access into and out of the channel via the open side is at a maximum, and a closed position in which access into and out of the channel via the open side is at a minimum, the open side of the channel being at least partly occluded by the occluder element.

In use the occluder element moves between the open position in which the safety line can pass into and out of the channel, and the closed position in which the safety line is prevented from passing into and out of the housing by the occluder element.

Beneficially the occluder element has an uppermost lip which is positioned overlapping the open sided channel when the occluder element is in the closed position.

Beneficially movement of the occluder element with respect to the traveller body is constrained and guided along a predetermined path between the open and closed positions. The guide path beneficially has components in orthogonal directions.

It is preferred that the occluder element moves bodily and translationally between the open position and the closed position. Beneficially the occluder element is orientated in substantally the same plane in both the open position and the closed position.

In a preferred embodiment guide channels are formed in one of the traveller body or the occluder element, the other being provided with follower formations to move within the guide channels. In such an embodiment, the guide channels may have guide limbs extending in mutually transverse directions.

The traveller may feature a movement enabling means which enables it to move along the safety line. This movement enabling means may take the form of one or more wheels, or it may be a portion of the housing itself configured such that the traveller is able to slide along the safety line. However, a person skilled in the art will understand that other movement enabling means may be used.

It is preferred that the movement enabling means is situated at or towards the top of the traveller, such that in use the traveller is suspended from the safety line, the movement enabling means coming into contact with the safety line.

Preferably, the open side of the channel is an elongate side preferably extending completely across the traveller in the longitudinal direction of the channel. The open side of the channel is preferably defined by a channel.

When the occluder element is in the open position, the channel within the traveller body is preferably exposed to enable the insertion of a longitudinal section of safety line into the traveller.

The occluder element and the housing both include a connection means to enable a lanyard (such as a cable, strap, rope or line) to be connected to the traveller. The opposing end of the lanyard is connected to the user by some means such as a harness. It is preferred that both connection means are apertures through which a lanyard connecting device (such as a karabiner) may be inserted and fastened.

When the occluder element is in the open position, the aperture on the occluder element is out of alignment with the corresponding aperture on the housing. Thus, it is not possible to pass the karabiner through the traveller, and it is not possible for a lanyard (and therefore a person) to be connected to the traveller while the occluder element is in the open position with the safety line exposed and in danger of becoming dislodged from the housing.

When the longitudinal section of the safety line is positioned within the housing of the traveller, the occluder element is moved to the closed position. When in the closed position, the safety line is held captive within the housing such that it cannot be removed or become dislodged.

In a preferred embodiment, the safety line is prevented from exiting the housing because the occluder element, a portion thereof, or some member attached to the occluder element, traverses the mouth of the housing so as to completely or partially block it. Thus, the safety line is held captive by the obstruction.

When the occluder element is in the closed position, the aperture on the occluder element is aligned with the aperture on the housing. In other words, the aperture on the occluder element is superimposed over the aperture on the housing, such that a single aperture is formed. Thus, an opening is formed through both the occluder element and the housing, through which the karabiner (or other lanyard connector) may be fastened. When the karabiner is passed through the apertures, its presence prevents movement of the occluder element back to the open position. As the safety line can only move into or out of the housing when the occluder element is in the open position, this eliminates the possibility of the safety line being removed from the traveller when a karabiner (and thus a person) is attached.

When it is desirable to disconnect the user from the traveller, the karabiner is withdrawn from the apertures. The occluder element can then be returned to the open position thus removing the impediment from the mouth of the housing, and exposing the safety line which may then be extracted from the housing.

These and other aspects of the present invention will be apparent from, and elucidated with reference to, the embodiment described herein.

An embodiment of the present invention will now be described by way of example only and with reference to the accompanying drawings.

DETAILED DESCRIPTION OF THE PREFERRED EMBODIMENT

Figure 1:
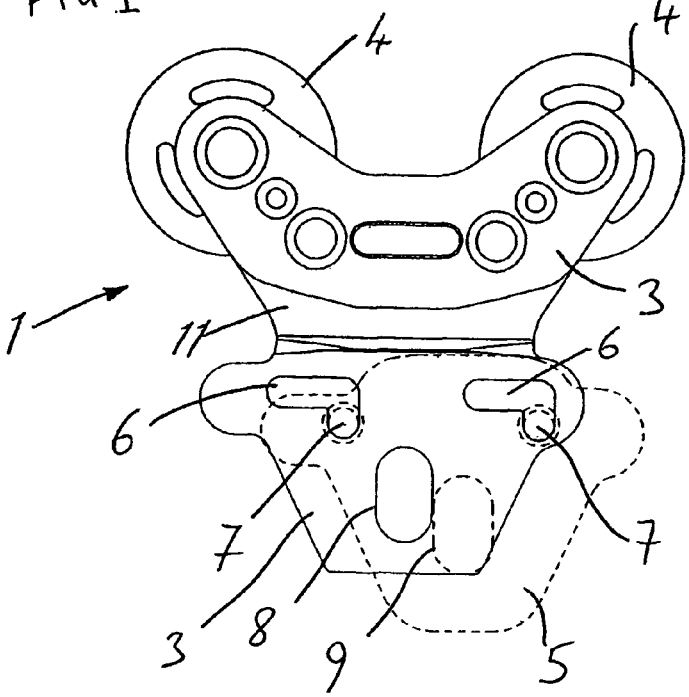
FIG. 1 shows a safety line traveller in accordance with the present invention wherein the occluder element is in the open position such that a safety line may be inserted into a cavity or channel within the housing. Connection means (i.e. lanyard attachment apertures) in the housing and occluder element are out of alignment thus preventing attachment of a lanyard to the traveller.

With reference to the drawings a traveller (1) is configured and arranged for use with a safety line (2). Such safety lines (2) are used in locations where personnel are required to operate at height and there is a danger of injury or death from falling. The safety line (2) is anchored to a stable structure, such as a series of support posts. This is a conventional arrangement.

The traveller (1) comprises a traveler body (3), an occluder element (5) and a pair of guide wheels (4) supported above the traveler body (3) such that the traveller is suspended from the safety line (2) for movement along the safety line. Alternatively, some other means for permitting travel may be employed to effect movement of the traveller along the safety line. For example, the interior of the traveler body (3) may be configured to permit sliding of the traveller along the safety line.

The traveler body (3) is configured to receive and accommodate a longitudinal section of safety line (2). In a preferred embodiment, the traveler body (3) has a longitudinal open sided channel (11) having an open side mouth extending the width of the traveller such that it can receive the longitudinal section of safety line through the open sided mouth opening into the channel (11).

Figure 2:
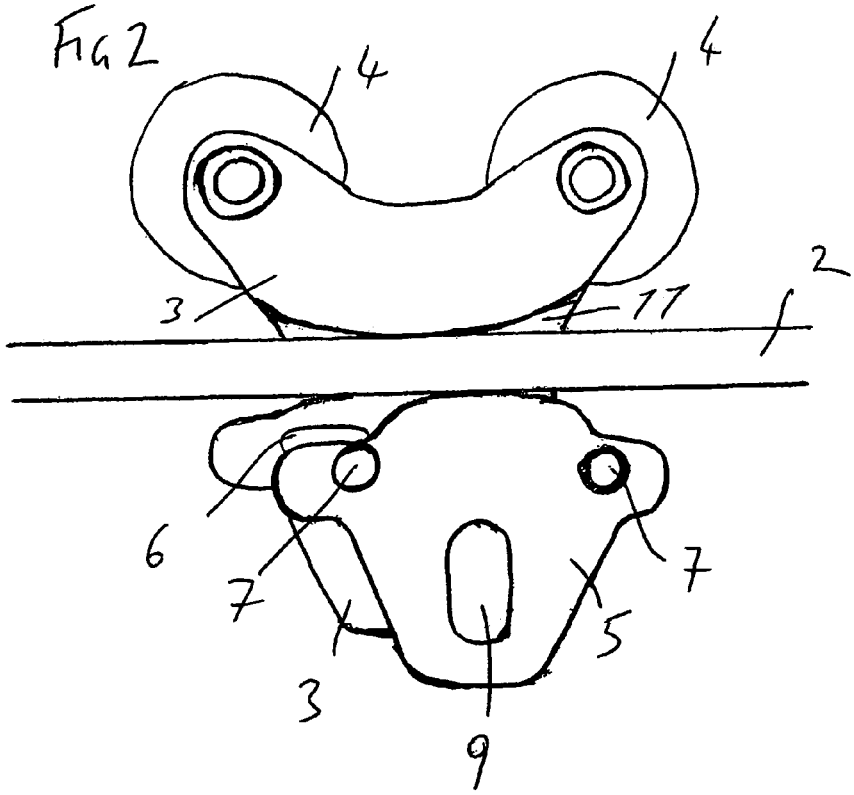
FIG. 2 shows a safety line traveller in accordance with the present invention wherein the occluder element is in the open position and a safety line is shown as accommodated within the housing.
Figure 3:
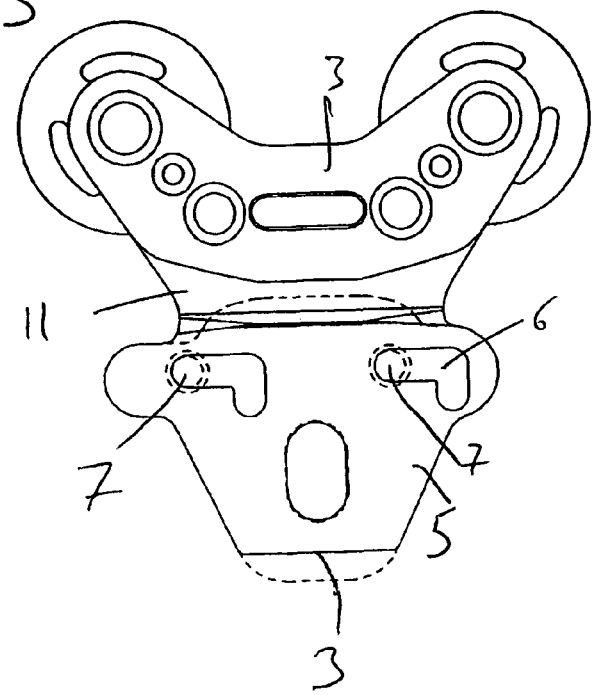
FIG. 3 shows a safety line traveller in accordance with the present invention wherein the occluder element is in the closed position such that a portion of the occluder element protrudes over the opening of the housing to prevent insertion/removal of the safety line into/from the housing, and lanyard attachment apertures in the housing and occluder element are aligned thus permitting attachment of the lanyard to the traveller.
Figure 4:
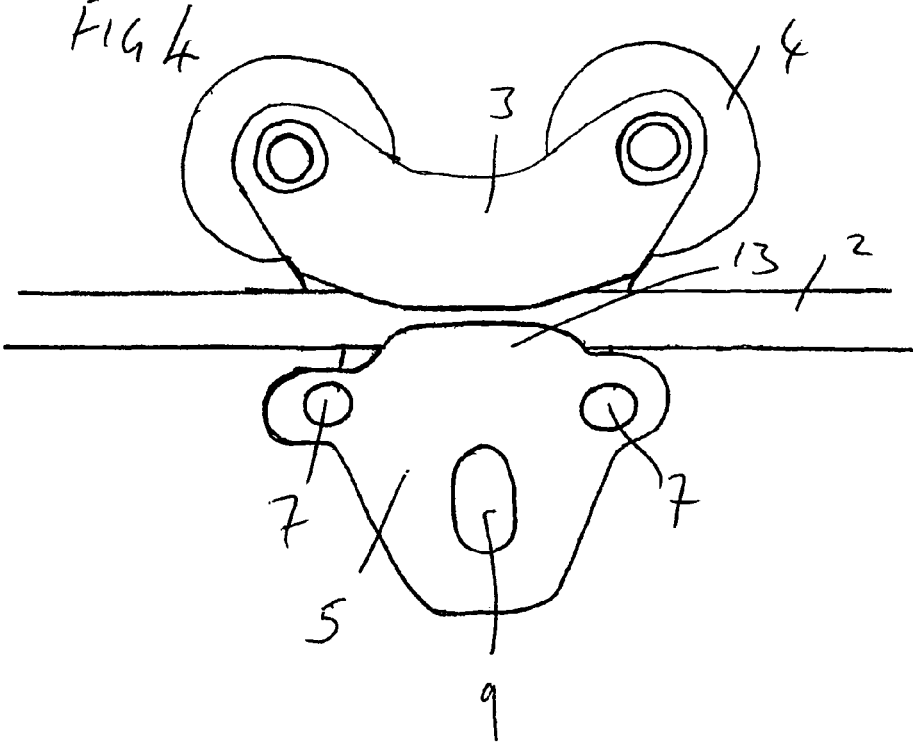
FIG. 4 shows a safety line traveller in accordance with the present invention wherein the occluder element is in the closed position and a safety line is held captive within the housing by the protrusion of a portion of the occluder element.

An occluder element (5) is mounted to the traveler body (3) such that it may move relative to the traveler body (3) between a closed (or occluding) position in which it extends at least partially across the mouth opening to the channel (11) of the traveler body (3), and a retracted (or open) position in which the occluder element (5) does not interfere with access via the mouth opening into the line receiving channel (11) of the traveler body (3). As shown in FIGS. 1 and 2, when the occluder element is in the open position, the channel (11) within the traveler body (3) is exposed so that a longitudinal section of the safety line can be inserted into the traveller (1) via the channel mouth. As FIG. 1 illustrates, the relatively lower orientation of the occluder element (5) when in the retracted position means that the occluder element drops downwards under gravity such that the mouth of the cavity is exposed to permit insertion of (or removal of) the safety line.

When the occluder element (5) is in the closed position, the occluder element has an uppermost lip (13) which is positioned overlapping the open sided channel. This prevents the safety line entering, or being removed from, the open channel (11) via the open mouth side.

The occluder element (5) moves (slides) bodily and translationally (i.e. non-rotationally) between the open position and the closed position. The occluder element (5) is orientated in substantially the same plane in both the open position and the closed position. This provides a compact and robust arrangement.

The traveler body (3) is provided with a connection portion below the channel (11) which includes a connection aperture (8) through which a karabiner of a lanyard may secure. The occluder element (5) also includes a connection aperture (8) corresponding in shape and dimension to the connection aperture of the traveler body (3). As can be clearly seen, the drawings, the connection apertures are arranged to overlay coincidentally one another, only when the occluder element is in the occluding position with respect to the mouth of channel (11). When the occluder element (5) is in the retracted or open position, the connection apertures (8) (9) do not match up. As a result, it is only possible to secure the lanyard karabiner through the apertures (8) (9) when they are in match-up orientation, and with the karabiner in position extending through the apertures (8) (9) it is not possible for the safety line (2) to pass sideways out of the channel (11). Consequently, the traveller may only be secured to, and removed from the safety line, when a karabiner is not secured through the apertures (8) (9) in the traveller.

Movement of the occluder element (5) with respect to the traveler body (3) is constrained and guided along a predetermined path, preferably to have a path having components in orthogonal directions. In the arrangement shown this is achieved by having guide channels formed in one of the components (guide slots (6) in the traveler body (3)) limbs extending in mutually perpendicular directions. Follower pins 7 carried by the occluder element (5) are guided along the guide channels as the occluder element (5) moves between the occluding and retracted positions. The follower pins are provided with head portions (not shown) of greater dimension than the width of slots 6 in order to ensure that the occluder element is held captive with respect to the traveler body (3) whilst being movable between the open and closed positions. The path is guided such that as the occluder element (5) moves between the occluding and retracted positions the movement is downwards and to the side. Such an arrangement minimizes the travel distance required of the occluder element (5) with respect to the traveller body in order to bring the connection apertures (8) (9) into alignment. It will be appreciated that a diagonally extending guide channel would have similar effect.

Thus, the risk of injury from falling is eliminated by preventing attachment of the personnel while the traveller is in the open configuration.

When the traveller is to be used, the longitudinal section of safety line is inserted into the exposed cavity of the traveler body (3) at the desired location along the safety line. The occluder element (5) is then moved to a closed position so that the user can be connected to the traveller by means of a lanyard (such as a strap, cable, rope, etc.). Safety line (2) cannot be removed or become dislodged from the housing while a user is attached, reducing or eliminating the risk of injury.

It should be noted that the above-mentioned embodiment illustrates rather than limits the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. An apparatus for use with a safety line, comprising:

a body having a receiving channel defining a longitudinal axis and a mouth opening, the receiving channel configured to receive a longitudinal section of the safety line into coaxial alignment with the receiving channel;

an occluder element configured to translate relative to the body, in a direction parallel to the longitudinal axis and the received longitudinal section of the safety line, across at least part of the mouth opening when mechanically mounted to the body for movement between an open position which provides sufficient access to the receiving channel to allow the safety line to be inserted therein or removed therefrom, and a closed position in which the mouth opening of the receiving channel is at least partly occluded by the occluder element to prevent passage of the safety line out of the receiving channel; and a connector configured to connect the apparatus to a lanyard when the occluder element is in the closed position, but not when the occluder element is in the open position, and wherein the connector includes a plurality of apertures which are aligned when the occluder element is in the closed position, but are out of alignment when the occluder element is in the open position, and wherein said apertures are provided through each of the occluder element and the body, and said apertures are arranged to match-up with one another when the occluder element is in the closed position.

2. An apparatus according to claim 1, wherein:

the occluder element is orientated in substantially the same plane in both the open position and the closed position.

3. An apparatus according to claim 1, wherein:

translational sliding movement of the occluder element relative to the body is constrained and guided along a predetermined path between the open and closed positions.

4. An apparatus according to claim 3, wherein:

the predetermined path has components in orthogonal directions.

5. An apparatus according to claim 3, wherein:

guide channels are formed in one of the body and the occluder element, and the other of the body and the occluder element is provided with follower formations to move within the guide channels.

6. An apparatus according to claim 5, wherein:

the guide channels have limbs extending in mutually transverse directions.

7. An apparatus according to claim 1, wherein:

said apertures provide a passageway through the apparatus when they are in alignment such that a lanyard connection device can pass through the apparatus when the occluder element is in the closed position.

8. An apparatus according to claim 7, wherein:

the presence of the lanyard connection device passing through the aligned apertures prevents the occluder element from moving to the open position.

9. An apparatus according to claim 1, wherein:

the apparatus is configured to move along the safety line in a rolling, sliding or gliding motion.

10. An apparatus according to claim 1, wherein:

the body is configured to move along the safety line.

11. An apparatus according to claim 10, wherein:

the body includes at least one wheel.

12. An apparatus for use with a safety line, the apparatus comprising:

a body having a receiving channel defining a longitudinal axis and a mouth opening, the receiving channel configured for receiving a longitudinal section of the safety line in coaxial alignment with the receiving channel;

an occluder element configured to translate relative to the body in a direction parallel to the longitudinal axis and the received longitudinal section of the safety line when the occluder element is mechanically mounted to the body for movement between an open position which provides sufficient access to the receiving channel to allow the safety line to be inserted therein or removed therefrom, and a closed position in which the mouth opening of the receiving channel is at least partly occluded by the occluder element to prevent passage of the safety line out of the receiving channel, wherein the occluder element is configured to slide translationally in a first direction transverse to the longitudinal axis of the receiving channel and across the mouth opening of the channel when moving between the open position and the closed position; and a connector configured to connect the apparatus to a lanyard when the occluder element is in the closed position, but not when the occluder element is in the open position, wherein the connector includes a plurality of apertures which are aligned when the occluder element is in the closed position, but are out of alignment when the occluder element is in the open position, and wherein said apertures are provided through each of the occluder element and the body, and said apertures are arranged to match-up with one another when the occluder element is in the closed position.

13. An apparatus for use with a safety line, comprising:

a body having a receiving channel defining a longitudinal axis and a mouth opening, the receiving channel configured for receiving a longitudinal section of the safety line in coaxial alignment with the receiving channel;

an occluder element configured to translate relative to the body in a direction parallel to the longitudinal axis and the received longitudinal section of the safety line when the occluder element mechanically mounted to the body for movement between an open position which provides sufficient access to the receiving channel to allow the safety line to be inserted therein or removed therefrom, and a closed position in which the mouth opening of the receiving channel is at least partly occluded by the occluder element to prevent passage of the safety line out of the receiving channel, wherein the occluder element is configured to slide translationally downward under the force to gravity to the open position; and a connector configured to connect the apparatus to a lanyard when the occluder element is in the closed position, but not when the occluder element is in the open position, wherein the connector includes a plurality of apertures which are aligned when the occluder element is in the closed position, but are out of alignment when the occluder element is in the open position, and wherein said apertures are provided through each of the occluder element and the body, and said apertures are arranged to match-up with one another when the occluder element is in the closed position.

14. The apparatus according to claim 1, wherein the receiving channel defines the longitudinal axis which extends through the entirety of the receiving channel.

* * * * *